US006041516A

United States Patent [19]

Preszler et al.

[11] Patent Number: 6,041,516

[45] Date of Patent: Mar. 28, 2000

[54] ARTICLE, APPARATUS AND METHOD FOR COOLING A THERMALLY PROCESSED MATERIAL

[75] Inventors: Duane A. Preszler, River Falls, Wis.; Kent R. Struble, Mahtomedi, Minn.; David J. McDaniel, Cottage Grove, Minn.; George G. Lunde, St. Paul, Minn.

[73] Assignee: Minnesota Mining & Manufacturing, St. Paul, Minn.

[21] Appl. No.: 09/162,671

[22] Filed: Sep. 29, 1998

Related U.S. Application Data

[62] Division of application No. 08/597,501, Feb. 2, 1996, Pat. No. 5,849,388.

[51] Int. Cl.[7] ..... F26B 7/00

[52] U.S. Cl. ..... 34/392; 34/393; 34/421; 34/430; 34/62; 34/66; 34/629

[58] Field of Search ..... 34/380, 391, 392, 34/393, 420, 421, 422, 429, 430, 575, 62, 66, 619, 629, 638; 219/216, 467, 468, 470; 396/575, 579; 347/262, 263, 155, 156

[56] References Cited

U.S. PATENT DOCUMENTS

| | | | |
|---|---|---|---|
| 3,628,440 | 12/1971 | Czarnikow et al. . | |
| 3,629,549 | 12/1971 | Svendsen . | |
| 3,648,019 | 3/1972 | Brewitz . | |
| 3,709,472 | 1/1973 | Kreitz et al. . | |
| 3,723,231 | 3/1973 | Clay et al. . | |
| 3,739,143 | 6/1973 | Amundson et al. . | |
| 3,774,520 | 11/1973 | Smith et al. . | |
| 3,817,618 | 6/1974 | Riley et al. . | |
| 3,973,059 | 8/1976 | Brown et al. . | |
| 4,031,281 | 6/1977 | Keeling . | |
| 4,076,532 | 2/1978 | Gottermeier . | |
| 4,102,456 | 7/1978 | Morris . | |
| 4,242,566 | 12/1980 | Scribner . | |
| 4,485,294 | 11/1984 | Rosenberg . | |
| 4,518,845 | 5/1985 | Svendsen . | |
| 4,644,667 | 2/1987 | Yanagi et al. . | |
| 5,248,539 | 9/1993 | Leonardi . | |
| 5,352,863 | 10/1994 | Svendsen . | |
| 5,414,488 | 5/1995 | Fujita et al. . | |
| 5,563,681 | 10/1996 | Kirkwold et al. . | |
| 5,641,374 | 6/1997 | Peterson et al. . | |
| 5,699,101 | 12/1997 | Allen | 347/212 |
| 5,790,069 | 8/1998 | McDaniel et al. | 347/263 |
| 5,869,806 | 2/1999 | Struble et al. . | |
| 5,869,807 | 2/1999 | Struble et al. . | |
| 5,895,592 | 4/1999 | Struble et al. | 219/216 |

FOREIGN PATENT DOCUMENTS

| | | |
|---|---|---|
| 0 679 946 A1 | 11/1995 | European Pat. Off. . |
| 0 679 947 A1 | 11/1995 | European Pat. Off. . |
| 3-208048 | 9/1991 | Japan . |

*Primary Examiner*—Stephen Gravini
*Attorney, Agent, or Firm*—William F. Noval

[57] ABSTRACT

An article for cooling an imaging material which has been heated to a first temperature by a thermal processor. The article includes a first cooling section on which the imaging material rides after the imaging material exits the thermal processor. The first cooling section is at a lower temperature than the first temperature. The first cooling section has a curved shape such that the imaging material is curved when riding on and being cooled by the first cooling section.

11 Claims, 5 Drawing Sheets

ARTICLE, APPARATUS AND METHOD FOR COOLING A THERMALLY PROCESSED MATERIAL

This application is a division of Ser. No. 08/597,501, filed Feb. 2, 1996, now 5,849,388.

TECHNICAL FIELD

The present invention relates generally to an apparatus and method for cooling a thermal-processed material and more specifically an apparatus and method for cooling a thermally-developed imaging material.

BACKGROUND OF THE INVENTION

The present invention includes a method and apparatus for cooling lengths of thermally-processed, light sensitive photothermographic or thermographic film. Light sensitive photothermographic film typically includes a thin polymer or paper base coated with an emulsion of dry silver or other heat sensitive material. Once the film has been subjected to photostimulation by optical means, such as laser light, it is developed through the application of heat.

Heat development of light sensitive heat developable sheet material has been disclosed in many applications ranging from photocopying apparatus to image recording/printing systems. The uniform transfer of thermal energy to the heat developable material is critical in producing a high quality printed results. The transfer of thermal energy to the film material should be conducted in a manner that will not cause introduction of artifacts. These artifacts may be physical artifacts, such as surface scratches, shrinkage, curl, and wrinkle, or developmental artifacts, such as non-uniform density and streaks. Numerous attempts to overcome the above mentioned artifacts have resulted in limited success.

The U.S. Pat. No. 4,242,566 describes a heat-pressure fusing apparatus that purports to exhibit high thermal efficiency. This fusing apparatus comprises at least one pair of first and second oppositely driven pressure fixing feed rollers, each of the rollers having an outer layer of thermal insulating material. First and second idler rollers are also included. A first flexible endless belt is disposed about the second idler roller and each of the first pressure feed rollers. A second flexible endless belt is disposed about the second idler roller and each of the second pressure feed rollers. At least one of the belts has an outer surface formed of a thermal conductive material. An area of contact exists between the first and second pressure feed rollers and allows the heat developable light sensitive sheet material to pass between two belts while under pressure. When an unfused (undeveloped) sheet of material is passed through the area of contact between two belts, the unfused sheet is subjected to sufficient heat pressure to fuse the development of the sheet of material. This apparatus, although useful for photocopying applications, will subject the sensitive material to excessive pressure. Excessive pressure can result in the formation of physical image artifacts, such as surface scratches and wrinkles, especially if the material is of polyester film construction.

In U.S. Pat. No. 3,739,143, a heat developer is described for developing light sensitive sheet material without imparting pressure to the sensitive coating while the sheet material is being heated. This developer includes a rotating drum cylinder and an electrically heated metal plate where it is partially covering the cylinder and spaced therefrom to define a space for the sheet material corresponding to the thickness of sheet material. The sheet material is guided through an opening to be wrapped around the rotating cylinder while heat is being applied by the metal plate partially covering the rotating cylinder. While this developer may satisfactorily develop paper-based heat-developable image, this developer is not well suited to develop polyester film base material having imprecise control of film heating and pressure application. In addition, the curled path can introduce curling artifacts when the polyester film material is used.

U.S. Pat. Nos. 3,629,549 and 4,518,845 both disclose developers having thermally insulating drums concentrically mounted within a heating member. Sheets of light sensitive material such as coated paper or coated polyester film are developed by being engaged by the drum and driven around the heating member. While the developers of this type may be suited well for paper coated light sensitive material, they tend to develop various artifacts in a polyester film with coated emulsion, such as scratches and nonuniform density development when the film sticks to the drum surface.

The development device disclosed in U.S. Pat. No. 3,709,472 uses a heated drum to develop strips of film. However, this device is not suitable for developing single sheets of film having soft coated emulsion layers.

U.S. Pat. No. 3,648,019 discloses another developer with a pair of heaters on opposite sides of a low thermal mass locating device, such as a screen assembly. Although portable, this developer is relatively slow and poorly suited for commercial applications.

Other photothermographic film developers include a heated drum which is electrostatically charged to hold the film thereon during development. Since the side of the film bearing the emulsion is not in contact with the drum or other developer components, it is not subject to sticking or scratching as in some of the developers discussed above. Unfortunately, the electrostatic system used to hold the film on the drum during development is relatively complicated and poorly suited for developers configured to develop larger sized sheets of film.

The U.S. Pat. No. 5,352,863 discloses a photothermographic film processor purported to be capable of quickly and uniformly developing large sheets of photothermographic film. This developer consists of an oven having a film entrance and exit; a generally flat and horizontally oriented bed of film support material mounted for movement within the oven along a film transport path between the film entrance and exit; and, a drive mechanism for driving the bed of material to transport the film through the oven along the path. The film support material, which is in the form of the padded rollers, is noted to have a sufficiently low thermal capacity to enable visible pattern-free development of the film as the film is transported through the oven. Unfortunately, this apparatus is relatively large and has not fully addressed the need to manage the thermal expansion and contraction of the imaging material to prevent, for example, wrinkling, nor the need to minimize the effect of convective currents during the thermal development of the imaging material.

In general, and as it is discussed in the background sections of the patents referenced above, the density of the developed image is dependent upon the precise and uniform transfer of heat to the film emulsion. Nonuniform heating artifact can produce an unevenly developed image density. Uneven physical contact between the film and any supporting structures during development can produce visible marks and patterns on the film surface.

It is evident that a continuing need exists for improved photothermographic film developers. In particular, there is a need for a developer capable of quickly and uniformly developing large sheets of polyester, emulsion- coated film without introducing physical and developmental artifacts that are described above.

SUMMARY OF THE INVENTION

The present invention provides an apparatus and method which addresses the need to minimize artifacts created during the cooling of an imaging material. One embodiment of the present invention includes an article for cooling an imaging material which has been heated to a first temperature by a thermal processor. The article includes a first cooling section on which the imaging material rides after the imaging material exits the thermal processor. The first cooling section is at a lower temperature than the first temperature. The first cooling section has a curved shape such that the imaging material is curved when riding and being cooled by on the first cooling section.

Another embodiment of the present invention includes a method for cooling a heated imaging material which has been heated to a first temperature by a thermal processor. The method includes the step of transporting the heated imaging material to ride on and be cooled to a second temperature by a first cooling section of a cooling article after the imaging material exits the thermal processor. The first cooling section is at a lower temperature than the first temperature. The first cooling section has a curved shape such that the imaging material is curved when riding on and being cooled by the first cooling section.

Another embodiment of the present invention includes a cooling apparatus for cooling an imaging material which has been heated to a first temperature by a thermal processor. The cooling apparatus includes a cooling article having a first surface and an opposite second surface, the first surface being positioned to receive the imaging material such that the imaging material rides over the first surface after the imaging material exits the thermal processor. The cooling apparatus includes first means for directing a first fluid stream across the second surface of the cooling article. The first fluid stream has a sufficient velocity to maintain the cooling article within a cooling temperature range when cooling the imaging material and when cooling successive imaging materials.

BRIEF DESCRIPTION OF THE DRAWINGS

The foregoing advantages, construction and operation of the present invention will become more readily apparent from the following description and accompanying drawings in which.

DETAILED DESCRIPTION OF THE PREFERRED EMBODIMENTS

Figure 1:
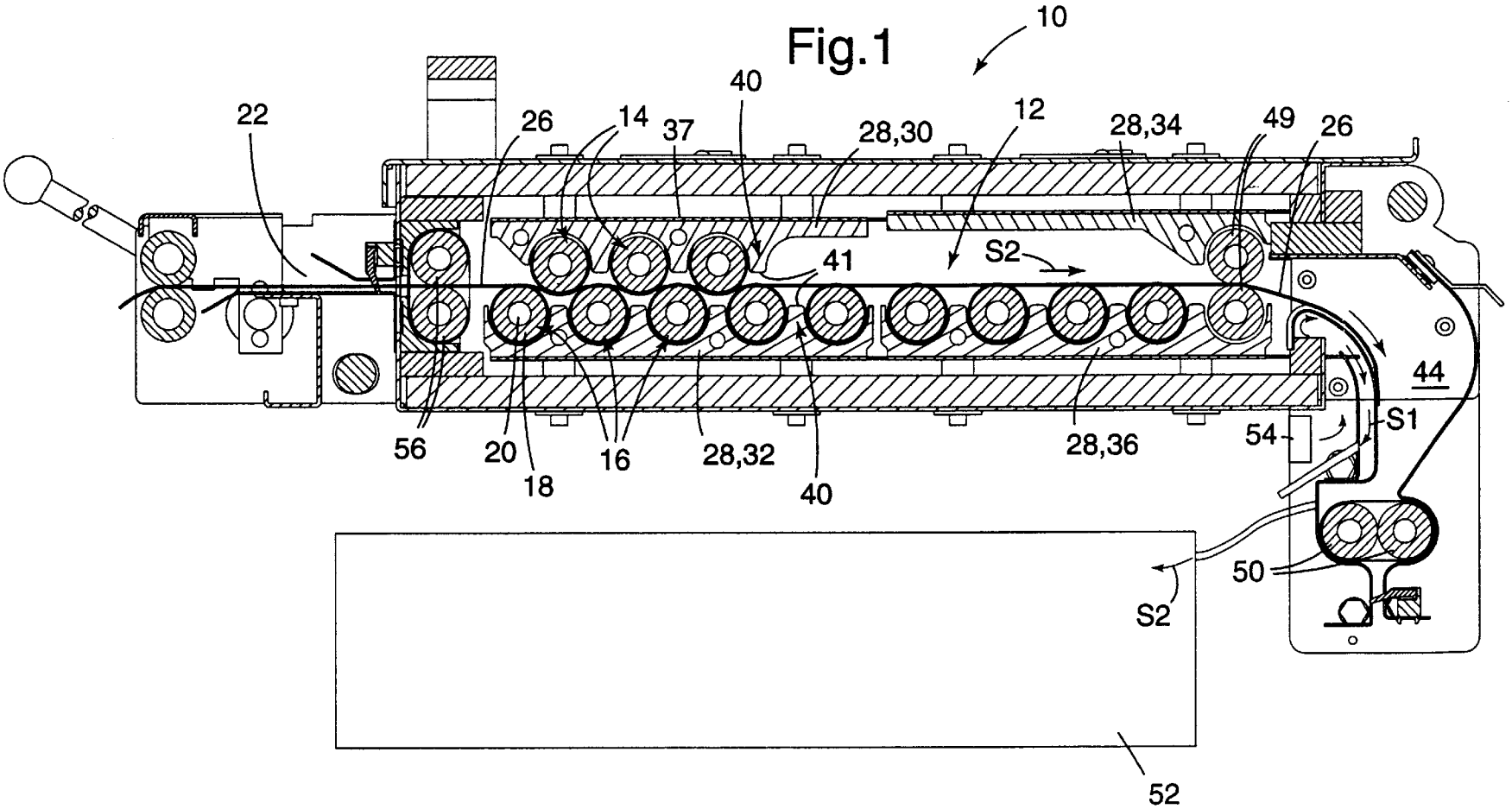
FIG. 1 is a side sectional view of one embodiment of a thermal processor in accordance with the present invention.

A thermal processor 10 in accordance with the present invention is illustrated in FIGS. 1–4 and 6. The thermal processor 10 can include a heated enclosure or oven 12 and a number of upper rollers 14 and lower rollers 16 therein.

Rollers 14, 16 can include support rods 18 with cylindrical sleeves of a support material 20 surrounding the external surface of the rods 18. The rods 18 are rotatably mounted to the opposite sides of oven 12 to orient rollers 14, 16 in a spaced relationship about a transport path between an oven entrance 22 and oven exit 24. The rollers 14, 16 are positioned to contact a thermally processable material 26 (hereinafter TPM 26), such as a thermally processable imaging material. Examples of thermally processable imaging materials include thermographic or photothermographic film (a film having a photothermographic coating or emulsion on at least one side). The term "imaging material" includes any material in which an image can be captured, including medical imaging films, graphic arts films, imaging materials used for data storage, and the like.

One or more of the rollers 14, 16 can be driven in order to drive the TPM 26 through the oven 12 and adjacent to heated members 28. Preferably, all of the rollers 14, 16 that contact the TPM 26 are driven so that the surface of each roller is heated uniformly when no TPM 26 is contacting the rollers 14, 16. As a result, the surface is maintainable within a relatively tight temperature range.

The support material 20 can be a low thermal mass, low thermal conductivity material, such as foam, such that it retains and transfers relatively insubstantial amounts of heat with respect to that generated by the oven and needed to develop the film. Using this type of material, conductive heat transfer is minimized and radiant heat transfer is accentuated. In addition, imperfections on the surface of the low thermal mass, low thermal conductivity material which contact the TPM 26 have little or no affect on the development of the TPM 26. An example of a low thermal mass, low heat conductivity material is a Willtec melamine foam having a density of 0.75 pounds per cubic foot (12.0 kg/m$^3$) and a thermal conductivity (K) of approximately 0.30 Btu-inch per hour-foot square-degree Fahrenheit is used for support material 20, specific heat of 0.3 Btu per pound-degree Fahrenheit. Material 20 of this type is commercially available from Illbruck Corp. of Minneapolis, Minn., U.S.A.

Other types of materials having similar or dissimilar thermal characteristics could be used, including silicone or polyimide foam. Materials of greater thermal mass and/or thermal conductivity could be used to increase the conductive heat transfer aspect and the total heat transfer, which could allow for increased throughput.

In one embodiment, the sleeves of support material 20 (melamine foam) can be about 1 inch (2.54 cm) in diameter, and fabricated by coring and grinding a block of stock to a thickness of about 0.25 inch (0.63 cm). The sleeves of material 20 are then mounted to steel rods 18. The center of the upper rollers 14 are spaced a distance D1 of approximately 1.25-inch (approximately 3.2 cm). The same is true of the lower rollers 16.

Figure 3:
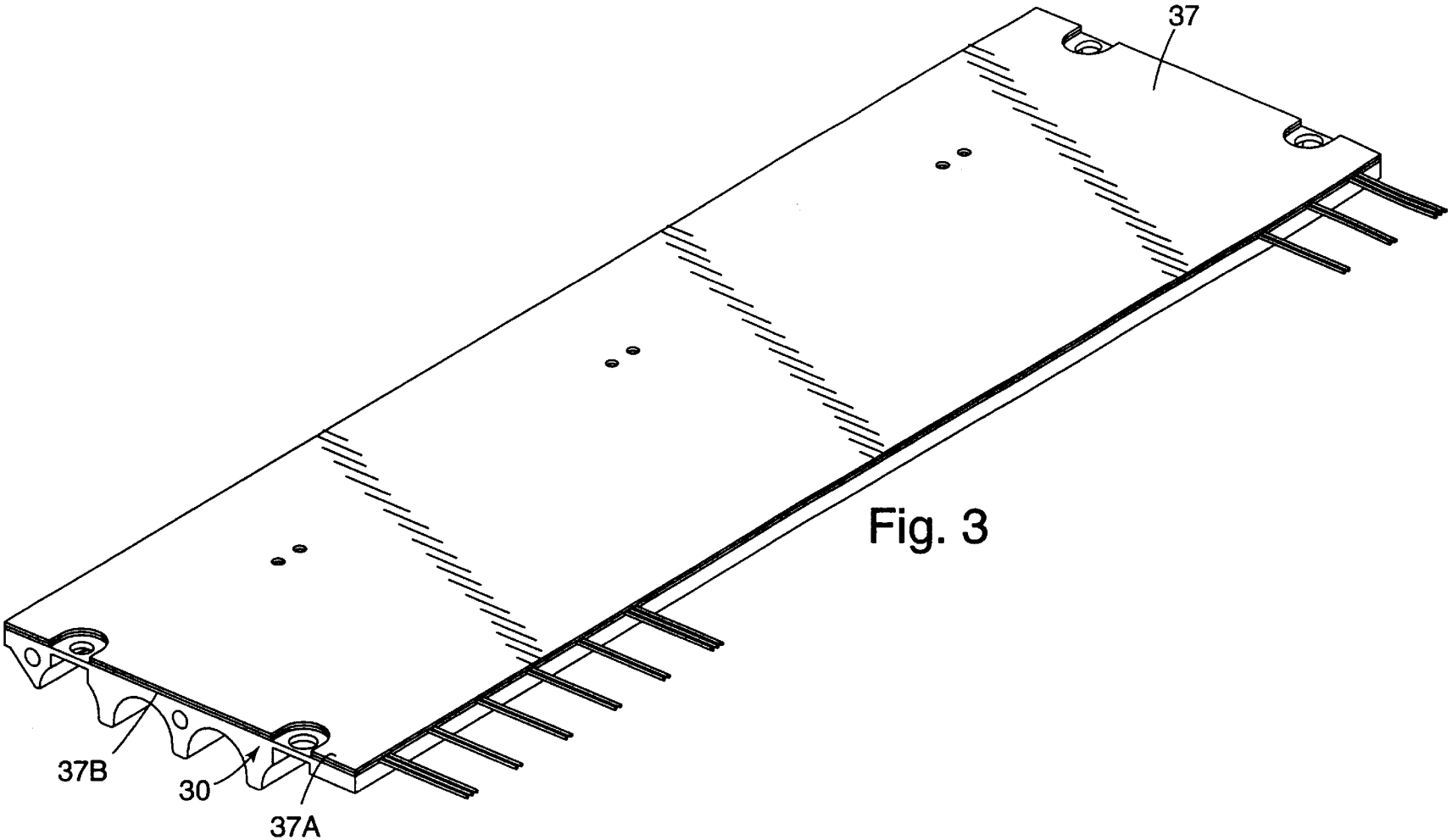
FIG. 3 is a partial side sectional view of the embodiment of the thermal processor shown in FIGS. 1 and 2.

The upper rollers 14 can be positioned, as shown, relative to the lower rollers 16 to cause the TPM 26 to be bent or curved when transported between the rollers 14, 16. Bending or curving the TPM 26 as shown in FIGS. 1 and 3 causes the TPM 26 to have a plurality of curvatures. Each of these curvatures has a curvature axis which is generally perpendicular to transport path of the TPM 26 through the oven 12. By saying "generally perpendicular," it is meant that the axis can be perpendicular to the transport path or close to being perpendicular to the transport path.

Creating these curvatures can be accomplished by positioning the rollers 14, 16 as shown in FIGS. 1 and 3. For example, the rollers 14, 16 can be positioned such that a horizontal line tangent to two or more of the lower portions of upper rollers 16 can be vertically spaced a distance D2 from a horizontal line which is tangent to two or more of the upper portions of the lower rollers 14.

Bending or curving of the TPM 26 increases the column stiffness of the TPM 26 and enables the TPM 26 to be transported through and heated up within the processor 10 without the need for nip rollers or other pressure-transporting means. Consequently, this column stiffness approach minimizes thermally-induced wrinkles of the TPM 26, which often appear in the direction of the transport path or diagonally (like an evergreen tree appearance) as a result of constraints associated with nipping (or other pressure application).

A distance D2 of approximately 0.1 inch (approximately 0.5 centimeter) has been shown to be effective when developing an 18-inch (45.7-centimeter) wide photothermographic film having, for example, a 4-mil (0.01 centimeter) polyester base. The composition of such a film is disclosed in pending U.S. patent application Ser. Nos. 08/529,982; 08/530,024; 08/530,066; and, 08/530,744 (assigned to 3M Company, St. Paul, Minn., U.S.A.), which are hereby incorporated by reference. This photothermographic film could be one which is useful as an image-setting film, the length of which can vary from shorter sheets to longer lengths on rolls.

The distance D2, however, can be empirically determined for processing other materials, such as a 14-inch (35.6-centimeter) by 17-inch (43.2-centimeter) sheet of medical imaging film having a 7-mil (0.018 centimeter) polyester base (e.g., DRYVIEW™DVC or DVB medical imaging film available from 3M Company, St. Paul, Minn., U.S.A.). In addition to the material choice, other factors can affect the optimal choice of the distance D2, including the width and the thickness of the material being developed, the transport rate of the material through the processor, and the heat transfer rate to the material.

The upper rollers 14 can be sufficiently spaced apart, as can the lower rollers 16, such that the TPM 26 can expand with little or no constraint in the direction generally perpendicular to the transport path. This minimizes the formation of significant wrinkles across the TPM 26 (generally perpendicular to the direction of the transport path). Furthermore, the minimization of these wrinkles can be accomplished without requiring that the TPM 26 be under tension when transported through the oven 12. This is particularly important when developing a TPM 26 of relatively short length, as opposed long length of material, such as a rollgoods material which can be pulled through the oven 12.

Four heated members 28 are shown as comprising a first upper heated member 30, a first lower heated member 32, a second upper heated member 34, and a second lower heated member 36. The heated members 28 can be heated with blanket heaters, such as the blanket heater 37 shown in FIG. 4 on the first upper heated member 30. The temperature of each blanket heater (and, therefore, heated members 28) can be independently controlled by, for example, a controller and a temperature sensor, such as a resistance temperature device or a thermocouple. Independent control of the heating elements 28 allows for more accurate control and maintenance of the temperature within the oven 12, and more critically, allows for consistent heat flow from the oven 12 to the TPMs 26 transported therethrough.

The thermal processor 10 has the ability to accurately control and maintain the temperature of the oven 12 when the oven 12 is in an idle state (no TPM 26 is being transported therethrough) and when the oven 12 is in a load state (a TPM 26 is being transported therethrough). The thermal processor 10 has the ability to compensate for the greater heat loss from the edges of the heated members 28 when in the idle state and for the additional heat loss in the inner portion of the heated members 28 when in the load state (due to heat flow to the TPM or TPMs 26).

Figure 4:
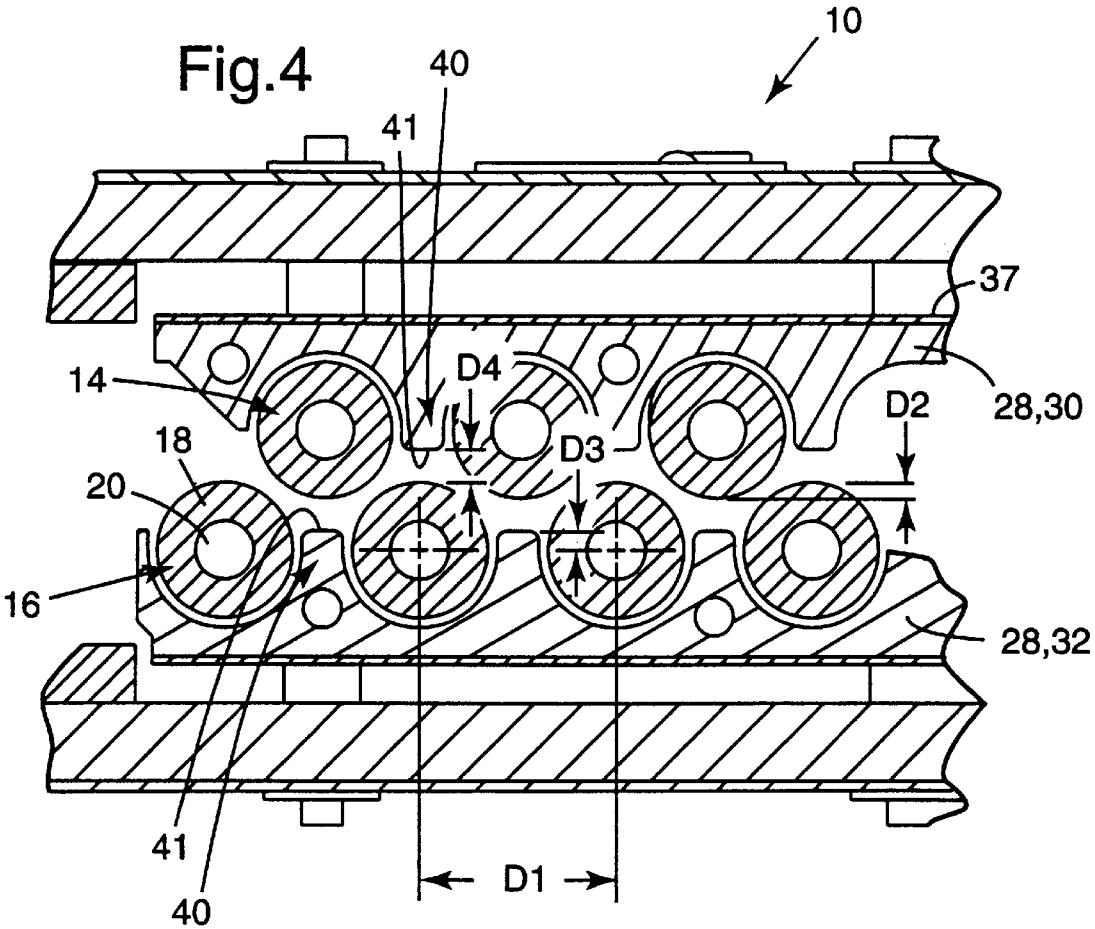
FIG. 4 is an isometric view of a top heating assembly within the embodiment of the thermal processor shown in FIGS. 1–3.

One embodiment of the thermal processor 10 that provides this ability is shown in FIG. 4 as including two blanket heaters 37 for heating a surface of a corresponding heated members 28, one blanket on top of the other. The first of the two blanket heaters 37 could be considered an idle state heater 37A which can be engaged or energized when the oven 12 is in the idle state and in the load state. The idle state heater 37A can be constructed with a particular heat flux density to distribute heat to the corresponding heated member 28 such that greater heat is created at the edges of the blanket 37A and delivered to the edges of the corresponding heated member 28 to compensate for the greater heat loss from the edges of that heated member 28. The second of the two blanket heaters could be considered a load state heater 37B which is engaged or energized when the oven 12 is in the load state. The load state heater 37B can be constructed to have a particular heat flux density to distribute heat to the corresponding heated member 28 such that greater heat is created in the inner portion of the blanket 37B and delivered to the inner portion of the corresponding heated member 28 to compensate for the heat transferred to the TPM 26. Blanket heaters of this type are available from Minco Products, Inc. which is located in Minneapolis (Fridley), Minn., U.S.A.

In effect, this blanket heater arrangement transfers the same amount of heat to particular locations of the corresponding heated member 28 as the amount of heat transferred by those particular locations to the TPM 26. In other words, this arrangement adds heat where transferred to the TPM 26. The result is uniform temperature history of the heated members 28 during the processing of a TPM 26 such that the heat transferred to the TPM 26 is uniform and such that successive TPMs 26 are developed uniformly.

The heated members 28 can be shaped, as shown, to wrap around a circumferential portion of a number of the upper and lower rollers 14, 16. The wrap angle A can preferably range from 120 to 270 degrees of the circumference of a roller. More preferably, the wrap angle is approximately 180–200 degrees, and even more preferably, the wrap angle is approximately 190 degrees.

Another way of setting the degree to which a heated member 28 wraps around a roller is to choose the distance D3 from a heating fin 40, in particular, the fin face 41 of a heating in 40, to a plane created by the longitudinal axis of an adjacent roller. For the above-referenced rollers 14, 16, the distance D3 can be approximately 0.2 inch (0.5 centimeter), although the distance D3 could be greater or lesser.

The mating or wrapping shape and the close proximity of the heating fins 40 relative to the rollers 14, 16 more effectively maintain the temperature of the outer surface of the rollers 14, 16 as the rollers 14, 16 contact a TPM 26. This close, mating or wrapping arrangement causes the rollers 14, 16 to more uniformly transfer heat to the TPM 26.

With this wrapping arrangement, portions of the heated members 28 function as heating fins 40. The heating fins 40 fit between and relatively close to the rollers 14, 16. For example, the heating fins 40 are preferably as close as possible to the rollers 14, 16 without contact the rollers 14, 16.

By minimizing the size of the gap between the fin face 41 of a heating fin 40 and the TPM 26, radiant heat transfer efficiency and the conductive heat transfer efficiency (through a thinner layer of air) is increased. However, the size of the gap should be sufficient to prevent contact with the TPM 26 when no contact is desired, or sufficient to prevent the leading edge of a TPM 26 from catching on a heating fin 40 and possibly jamming the TPM 26 within the thermal processor 10.

The gap size between a fin face 41 and the TPM 26 can be indirectly set by choosing the distance D3 from a fin face 41 to a line tangent to a lower roller 16 positioned directly below or an upper roller 14 positioned directly above the fin face 41. For a 4-mil polyester base TPM 26, such as the previously described image-setting film, the distance D3 is preferably not significantly less than 0.2 inch (0.5 centimeter). For other materials, the minimum distance for distance D3 may be different.

The thinner layer of air within the gap also minimizes the effect of convective currents that can form and flow across the TPM 26. This, in turn, can minimize inconsistent convective heat transfer to the TPM 26 and inconsistent development of the photothermographic image.

The gap size is more consistently maintained by bending the TPM 26, as previously described, when the TPM 26 is transported adjacent to the heating fins 40. By bending the TPM 26, the increased column stiffness of the TPM 26 prevents or reduces the buckling of the TPM 26 when transported between the rollers 14, 16. And, as previously stated, this approach requires minimal pressure on the TPM 26 (e.g., no nipping of the TPM 26) as opposed means of positioning the TPM 26 relative to the fin faces 41.

The dimension and composition of the heated members 28 can be chosen to optimize their thermal mass. With optimal thermal mass, an acceptable variation of the temperature of the heated members 28 can be matched with an acceptable period of time required to heat each of the heated members 28 to a desired temperature. Minimizing the temperature variation is important as the temperature difference ($\Delta T_{rad}$) between the TPM 26 and the fin face 41 is a factor in the radiant heat transfer equation. Similarly, the temperature difference ($\Delta T_{cond}$) between the TPM 26 and the heated air adjacent to the TPM 26 is a key factor in the conductive heat transfer equation. And, maintaining the desired temperature differences ($\Delta T_{rad}$ and $\Delta T_{cond}$) is a key factor in uniform development within a TPM 26 and from one TPM 26 to the next.

To develop a length of the previously described image-setting film (TPM 26), the first upper and lower heated members 30, 32 are heated to approximately 275 degrees Fahrenheit (135 degrees Celsius) and the second upper and lower heating members 34, 36 are heated to approximately 260 degrees Fahrenheit (127 degrees Celsius). At these temperatures, the TPM 26 is preferably transported at a rate of 0.4 inch per second (1 centimeter per second). At this rate and these temperatures, the length of the first upper and lower heating members 30, 32 can preferably be approximately 6 inches (15.2 centimeters) and the length of the second upper and lower heating members 34, 36 can preferably be approximately 6 inches (15.2 centimeters).

To thermally process other thermally processable materials, these temperatures, lengths, and the transport rate can be adjusted as necessary. Similarly, to increase the throughput rate of the thermal processor 10, the transport length could be increased.

Heating the first upper and/or first lower heating members 30, 32 to higher temperatures than the second upper and/or second lower heating members 34, 36 (as noted above) provides, in essence, the oven 12 with two zones. This two-zone configuration is an effective way of increasing the throughput and minimizing the footprint of the thermal processor 10.

Within the first zone (the first zone being created by the first upper and lower heated members 30, 32, the corresponding rollers 14, 16, and the heated air adjacent to the heated members and the rollers), an amount of heat is transferred to the TPM 26 to rapidly heat the TPM 26 to within a target processing temperature range, such as approximately 240–260 degrees Fahrenheit (115–127 degrees Celsius). The transport rate of the TPM 26 through the oven 12 can be set such that the TPM temperature reaches, but does not yet exceed, the target processing temperature range when the TPM 26 is moving out of the first zone and into the second zone. (If transported more slowly through the first zone, the TPM 26 could be heated to above the target processing temperature range.)

The temperature of the second zone (second zone being created by the second upper and lower heated members 34, 36, the corresponding rollers 14, 16, and the heated air adjacent to the heated members and the rollers) can be set such that the TPM temperature is maintained within the target processing temperature range for a target dwell time. The target dwell time within the second zone is determined by the length of the second zone and by the transport rate of the TPM 26 through the second zone.

Figure 5:
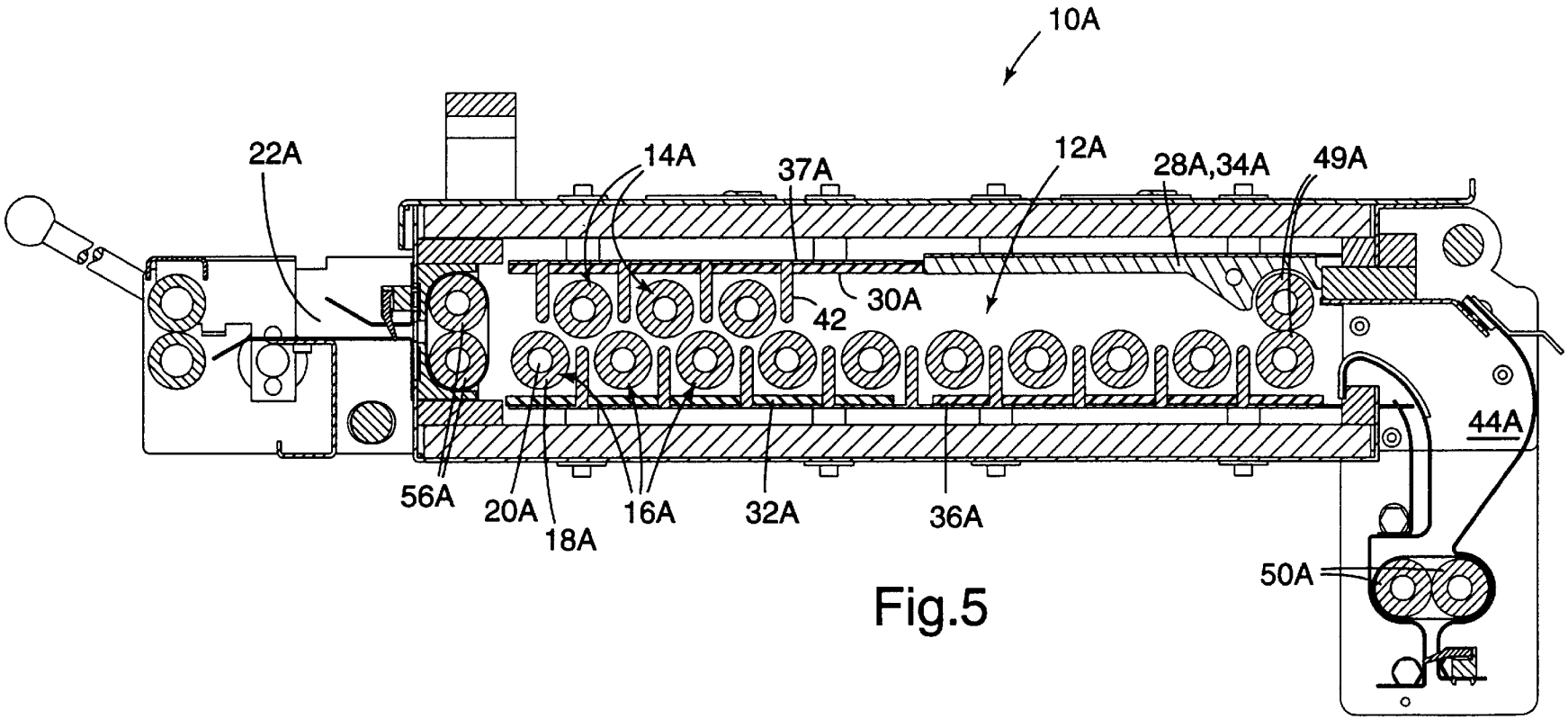
FIG. 5 is a side sectional view of another embodiment of the thermal processor in accordance with the present invention.

In FIG. 5, another embodiment of the thermal processor 10A includes screens 42A in place of the heating fins to minimize the effect of convective currents (created by the heated members 28A) on the development of the photothermographic image. The screens 42A are physical barriers positioned between many of the lower rollers 16A to stop or divert the flow of air currents along the surface of the TPM 26A (for example, the emulsion side when the emulsion side is adjacent to the lower rollers 16A). The screens 42A do not necessarily provide other advantages which are provided by the previously described heated fins 40.

Figure 2:
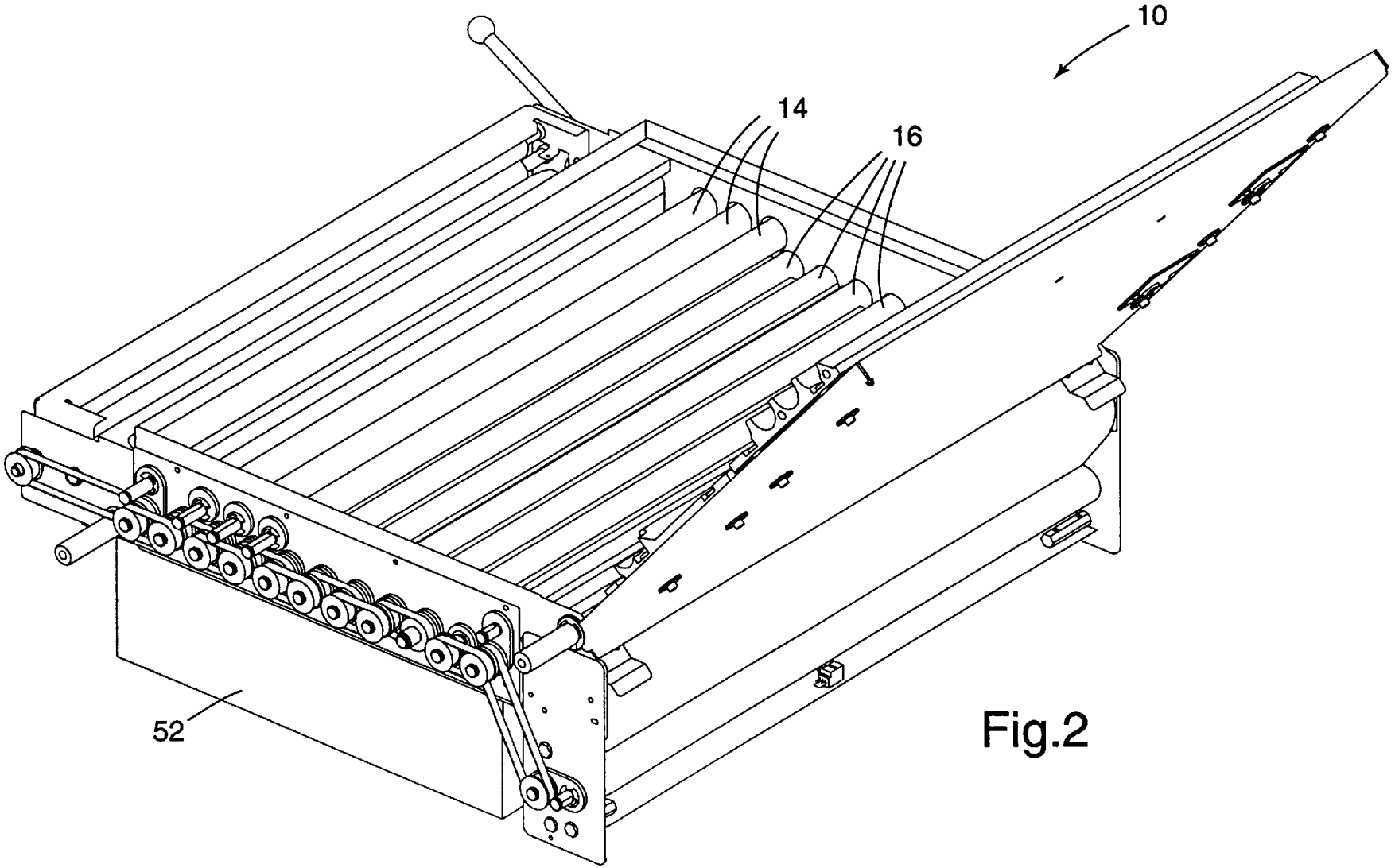
FIG. 2 is an isometric view of the embodiment of the thermal processor shown in FIG. 1 having an opened cover.

From the oven 10, the TPM 26 is transported into a cooling chamber 44, as shown in FIGS. 1 and 2. This portion of the thermal processor 10 is intended to lower the temperature of the TPM 26 to stop the thermal development while minimizing the creation of wrinkles in the TPM 26, the curling of the TPM 26, and the formation of other cooling defects.

Figure 6:
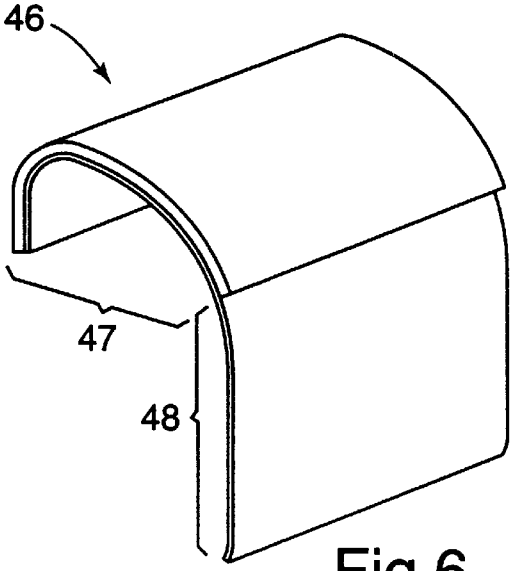
FIG. 6 is a isometric view of a cooling member within the thermal processor shown in FIGS. 1 and 5.

The cooling chamber 44 can include a cooling surface 46 (a portion of which is shown in FIG. 6) over which the TPM 26 rides. The cooling portion includes a first cooling portion 47 which is curved and a second cooling portion 48 which is relatively straight. Contact between the heated TPM 26 and the curved, first cooling portion 47 cools the TPM 26 while the TPM 26 is curved or bent. The degree of curving or bending increases the column stiffness of the TPM 26 which minimizes the formation of wrinkles. For cooling the previously mentioned image-setting film, the radius of the first cooling portion 47 where the TPM 26 contacts the first cooling portion 47 can be approximately 1.5 inches (3.8 centimeters).

The location of the first cooling portion 47 is important in that the TPM 26 is curved and be cooled by the first cooling portion 47 just after the TPM 26 exits the oven 12, that is, just after the TPM 47 is heated to the development processing temperature range for the desired dwell time. With the correct location, curvature, contact time with the TPM 26, and cooling rate caused by contact with the TPM 26, the first cooling portion 47 can cool a heated, curved TPM 26 through a temperature range which would cause wrinkling if not for the fact that the first cooling portion 47 caused the TPM 26 to be curved during this critical cooling stage. Restated, the curving or bending of the TPM 26 when the TPM 26 is most susceptible to formation of cooling-induced wrinkles significantly reduces the formation of these wrinkles.

The shape of the cooling surface 46 and the transport rate of the TPM 26 can be set such that the TPM 26 contacts the second cooling portion 48 while the TPM 26 is still cooling. Because the final cooling of the TPM 26 occurs while the TPM 26 is straight (or more straight than when contacting the first cooling portion 47), curling of the TPM 26 can be reduced.

To control the cooling rate due to contact with the cooling surface 46, the cooling surface 46 can be made of a combination of materials. Each of the materials can have a different thermal conductivity. For example, the entire cooling surface 46 can be made of a relatively high thermal conductivity material (e.g., aluminum or stainless steel). A lower thermal conductivity material (e.g., velvet or felt) can cover all or part of the first cooling portion 47 (shown as the layer between the TPM 26 and the higher thermal conductivity material).

A preferred choice for the higher thermal conductivity material is a textured, 20-gage 304 stainless steel available from Rigidized Metals Corporation, (658 Ohio St., Buffalo, N.Y. 14203). A preferred texture is referred to as Rigitex pattern 3-ND. A preferred choice for the lower thermal conductivity material is a velvet available from J. B. Martin Company, Inc. (10 East 53rd Street, Suite 3100, New York, N.Y.) and is referred to by J. B. Martin as Style No. 9120, nylon pile/rayon backed, heatseal coated, light-lock velvet.

With this construction, the TPM 26 contacts the lower thermal conductivity material and the first cooling portion 47 of the cooling surface 46 as or just after the TPM 26 exits the oven 12. Then, the TPM 26 contacts the higher conductivity material and the second cooling portion 48 of the cooling surface 46 to complete the cooling process. Proper control of the cooling rate coupled with the curving or bending of the TPM 26 during the initial cooling process results in minimized wrinkles. The choice of the radius of the first cooling portion 47 and the choice of the material can change based on the type of TPM 26 being cooled and the transport rate desired.

The TPM 26 can be transported to the cooling surface 46 with a first pair of nip rollers 49 and transported from the cooling surface 46 by a second pair of nip rollers 50. The nip rollers 49, 50 can be coordinated such that the entire TPM 26 or a significant surface area of the TPM 26 contacts the cooling surface while being transported at approximately the same rate. This causes the TPM 26 to be more uniformly cooled and the development more uniformly halted.

The thermal processor 10 can also include means for causing air flow within the cooling chamber 44. Two streams of air can be useful, one for cooling the cooling surface 46 and one for removing and filtering air within the chamber 44 and within the oven 12. The first stream S1 can be a stream of ambient air (or cooling air) which is directed at the side of the cooling surface 46 opposite to the side of the cooling surface 46 which contacts the TPM 26. The first stream S1 can be created by a first fan 54 which pulls air in from outside the thermal processor 10 and directs the air against the cooling surface 46. The air can exit to outside the thermal processor 10 through an outlet.

The first stream S1 can have a flow velocity which is suited to cool the cooling surface 46 so that the entire length of a TPM 26 is uniformly cooled and so that successive TPMs 26 are uniformly cooled. Because this flow velocity may be excessive if flowing across the TPM 26 (thereby possibly causing excessively rapid cooling of the TPM 26 which can result in wrinkles), the first stream S1 is contained to that the first stream S1 does not directly contact the TPM 26. The first fan 54 can be chosen to create a volumetric flow rate of approximately 6–10 cubic feet per minute and an air velocity against the cooling surface 46 of approximately 3–9 feet per second (0.9–2.7 meters per second).

The second stream S2 of air within the cooling chamber 44 can flow adjacent to the TPM 26 to remove the gaseous bi-products. The second stream S2 can flow through the thermal processor 10 beginning at the oven entrance 22 and terminating at a filtering mechanism 52. The flow rate of the second stream S2 can be sufficiently low that the cooling of the TPM 26 by the second stream S2 does not create a wrinkling problem. A target volumetric flow rate could be approximately one air change per minute through the thermal processor 10.

The filtering mechanism 52 can create the second stream S2 by including means for pulling air through the oven 12, such as a second fan (not shown). The filtering mechanism 52 also includes a filter (not shown) which is designed to handle the gaseous bi-products created when certain photothermographic materials are thermally developed. An example of such a filtering mechanism 52 is described in U.S. Pat. No. 5,469,238 and pending U.S. patent application Ser. No. 08/239,888 (assigned to 3M Company) which are hereby incorporated by reference.

A third pair of nip rollers 56 are shown near the entrance 22 of the oven 12. In addition to transporting the TPM 26 into the oven 12, the third pair of nip rollers 56 partially seal the entrance 22. The space between the third pair of nip rollers 56 and the external walls adjacent to the nip rollers 56 is sufficiently small to prevent free exchange of air in and/or out of the entrance 22. However, the space can be sufficiently large to allow just enough air to supply the second stream S2 which flows to the filtering mechanism 52. Therefore, the air flow into the oven 12 through the entrance is controlled. This can be important in preventing non-uniform development due to uncontrolled air flow against the TPM 26.

The third pair of nip rollers 56 could more completely seal off the oven entrance 22 with a tighter fit with the external walls adjacent to the third pair of nip rollers 56. This further prevents the effects of the air flow from the entrance 22 and across the TPM 26. With a complete seal, the thermal processor 10 would either be without a second stream S2 or would require another source, such as an opening in another location in the oven 12.

Another embodiment (not shown) could have the heating members 30, 32 wrapping around the third pair of nip rollers 56 in order to heat them like the other rollers 14, 16, 49 within the oven 12. This could provide even greater control of the heat being transferred to the TPM 26.

Although the present invention has been described with reference to preferred embodiments, those skilled in the art will recognize that changes may be made in form and detail without departing from the spirit and scope of the invention. For example, the transport path can have other than the horizontal, generally straight orientation which is shown (e.g., an inclined straight transport path, a vertical straight transport path, an arched transport path, and the like). Also, a greater or lesser number of rollers 14, 16 could be used within the oven 12.

Still further, other blanket heater arrangements could be used. For example, a three-layer approach could be used. The upper layer could be the idle blanket heater, like that shown. The middle layer could be a first load blanket heater having a particular heat flux density which was chosen to compensate for the heat transfer to a TPM 26 having a width of, for example, 10 inches (25.4 centimeters). The lower layer could be a second load blanket heater having a particular heat flux density which was chosen to compensate for the heat transferred to a TPM 26 having a width of, for example, 20 inches (50.8 centimeters). With this dual capability, the thermal processor 10 could include a control (manual or automatic) which engages either the first load blanket heater or the second load blanket heater depending on which TPM 26 is being transported into the thermal processor 10. Additional blanket heaters could of course be added to provide the ability to handle TPMs 26 of different widths.

Sensors, such as edge-detecting sensors, at the oven entrance 22 could be used to sense the edge locations of the incoming TPM 26 and send a signal to a controller within the thermal processor 10. The controller could be designed to determine the width of the TPM 26 based on this signal and to engage the appropriate load blanket heater. Furthermore, this sensing approach could be used with heating means other than the overlapping blanket heaters, such as a single blanket heater. Such a single blanket heater could include multiple, independently-controllable zones such that the appropriate zones could be engaged or energized to process TPMs 26 of different widths.

What is claimed is:

1. A method for cooling a heated imaging material which has been heated to a first temperature by a thermal processor, comprising the step of transporting the heated imaging material to ride on and be cooled to a second temperature by a first cooling section of a cooling article after the imaging material exits the thermal processor, the first cooling section being at a lower temperature than the first temperature, the first cooling section having a curved shape such that the imaging material is curved when riding on and being cooled by the first cooling section.

2. The method of claim 1, the cooling article being cooled in order to cool one or more lengths of imaging material.

3. The method of claim 1, the curved shape having a radius of between 2 centimeters and 5 centimeters.

4. The method of claim 1, further comprising the step of transporting the imaging material to ride on and be further cooled by a second cooling section of the cooling article after the imaging material rides on the first cooling section, the second cooling section being relatively straight such that the imaging material is relatively straight when riding on the second cooling section.

5. The method of claim 1, the transporting step comprising transporting the imaging material at a transport rate which is sufficient such that the imaging material is cooled by the first cooling section to a cooled temperature, the cooled temperature being sufficiently low that further cooling of the imaging material to below the cooling temperature does not cause significant cooling-induced wrinkles.

6. A cooling apparatus for cooling an imaging material which has been heated to a first temperature by a thermal processor, the cooling apparatus comprising:

a cooling article having a first surface and an opposite second surface, the first surface being positioned to receive the imaging material such that the imaging material rides over the first surface after the imaging material exits the thermal processor; and first means for directing a first fluid stream across the second surface of the cooling article, the first fluid stream having a sufficient velocity to maintain the cooling article within a cooling temperature range when cooling the imaging material and when cooling successive imaging materials.

7. The cooling apparatus of claim 6, the cooling article comprising a first cooling section on which the imaging material rides after the imaging material exits the thermal processor, the first cooling section having a second temperature which is lower than the first temperature, the first cooling section having a curved shape such that the imaging material is curved when riding on the first cooling section.

8. The cooling apparatus of claim 7, the cooling article further comprising a second cooling section on which the imaging material rides after the imaging material rides on the first cooling section, the second cooling section having a third temperature which is less than the first temperature, the second cooling section being generally straight such that the imaging material is generally straight when riding on the second cooling section.

9. The cooling apparatus of claim 6, further comprising a second means for directing a second fluid stream across the first surface of the cooling article.

10. The cooling apparatus of claim 9, the first and second fluid streams being air streams.

11. The cooling apparatus of claim 6, further comprising means for preventing the first fluid stream from contacting the imaging material.

* * * * *